United States Patent [19]

Infanti

[11] Patent Number: 4,817,911

[45] Date of Patent: Apr. 4, 1989

[54] APPARATUS FOR FORMING ICE SCULPTURES

[75] Inventor: Vittorio Infanti, Staten Island, N.Y.

[73] Assignee: Infanti Chair Manufacturing, Corp., Staten Island, N.Y.

[21] Appl. No.: 194,442

[22] Filed: May 16, 1988

Related U.S. Application Data

[63] Continuation-in-part of Ser. No. 799,092, Nov. 18, 1985, abandoned.

[51] Int. Cl.[4] ..... F25C 1/22; B29C 39/40

[52] U.S. Cl. ..... 249/82; 249/55; 249/112; 249/114.1; 249/135; 249/167; 249/169; 249/170

[58] Field of Search ..... 249/55, 82, 112, 114.1, 249/115, 127, 134, 135, 165, 166, 167, 168, 169, 170, 171; 264/28; 425/62, DIG. 44; 426/515

[56] References Cited

U.S. PATENT DOCUMENTS

| | | | |
|---|---|---|---|
| 2,308,448 | 1/1943 | Hodge | 249/170 |
| 2,352,083 | 6/1944 | Detjen | 249/55 |
| 2,512,809 | 6/1950 | Perry et al. | 249/82 |
| 2,517,902 | 8/1950 | Luebkeman | 264/225 |
| 2,569,469 | 10/1951 | Gersten et al. | 249/134 |
| 2,688,493 | 9/1954 | Rosenberg | 280/47.34 |
| 2,939,299 | 6/1960 | Sherbloom | 249/55 |
| 2,958,918 | 11/1960 | MacMillan | 249/134 |
| 3,136,831 | 6/1964 | Zinn | 264/225 |
| 3,200,454 | 8/1965 | Gramenzi | 249/170 |
| 3,309,738 | 3/1967 | Friedman | 249/55 |
| 3,320,344 | 5/1967 | Slipp | 249/112 |
| 3,369,377 | 2/1968 | Wenting | 249/170 |
| 3,393,890 | 7/1968 | Lemelson | 249/55 |
| 3,643,911 | 2/1972 | Reid | 249/112 |
| 3,684,234 | 8/1972 | Clinebell | 249/112 |
| 3,989,220 | 11/1976 | Greenberg | 249/55 |
| 4,060,946 | 12/1977 | Lang et al. | 249/DIG. 3 |
| 4,206,899 | 6/1980 | Whitehead | 249/127 |
| 4,289,724 | 9/1981 | Baynard | 264/225 |
| 4,496,511 | 1/1985 | Virgili | 264/225 |
| 4,669,271 | 6/1987 | Noel | 264/28 |

OTHER PUBLICATIONS

Frados, Joel, *Plastics Engineering Handbook*, 4th Ed., Van Nostrand Reinhold Co, N.Y., N.Y., (1976), pp. 637–639.

*Primary Examiner*—Jay H. Woo
*Assistant Examiner*—James C. Housel
*Attorney, Agent, or Firm*—Louis Weinstein

[57] ABSTRACT

Apparatus for producing an ice sculpture comprising a compressible gasket arranged between a pair of mold halves which are yieldably joined by spring-loaded releasable locking toggle assemblies and spring loaded hinge assemblies respectively arranged along opposite sides of the mold halves to permit the formation of large ice sculptures.

27 Claims, 10 Drawing Sheets

*Fig. 3*
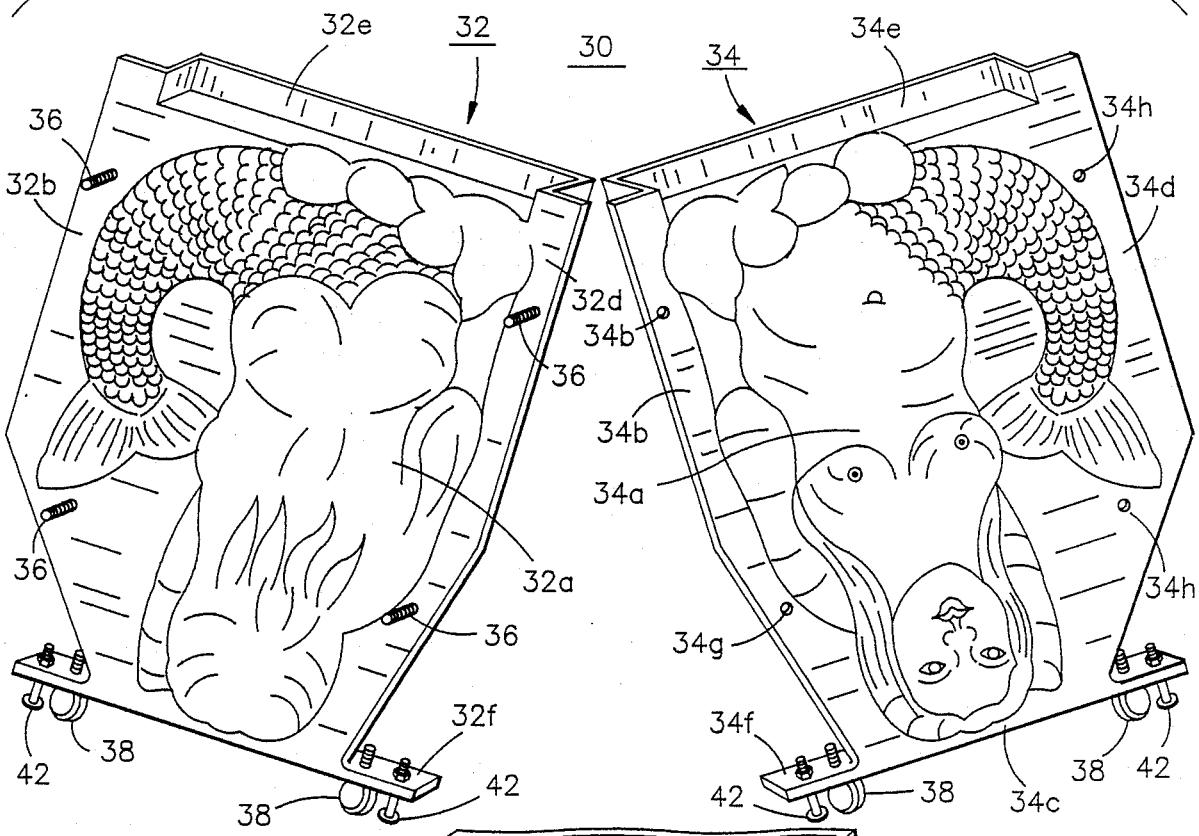
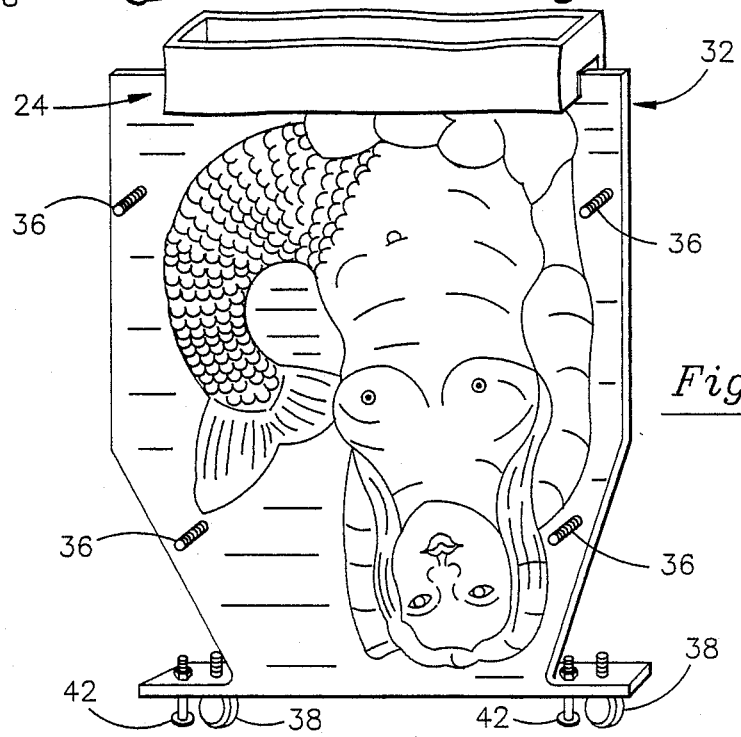
*Fig. 4*

APPARATUS FOR FORMING ICE SCULPTURES

This application is a continuation-in-part of Application Ser. No. 799,092 filed Nov. 18, 1985, now abandoned.

FIELD OF THE INVENTION

The present invention relates to ice sculptures and more particularly to novel method and apparatus for producing ice sculptures of high quality and fine detail in a simple and inexpensive manner.

BACKGROUND OF THE INVENTION

Ice sculptures are typically utilized by restaurants, catering groups and even individuals for complementing and beautifying table arrangements at luncheons, buffets, banquets and all sorts of catered affairs. Ice sculptures, and especially ice sculptures of large size, are typically sculptured from a large block of ice just prior to their time of use requiring a high degree of painstaking skill, making such ice sculptures rather costly.

Techniques have been developed for making small size ice sculptures from mold sections which are joined together by fastening members. However, they are impractical for use in producing large ice sculptures.

Other techniques utilizing a rubber-like mold having a sectionalized portion have been utilized to produce members made of plaster. This technique which also forms unsightly seams, further requires the provision of a supporting casting of plaster of paris molded about the exterior of the mold and which must be cut into sections to facilitate removal of the finished article.

BRIEF DESCRIPTION OF THE INVENTION

The present invention is characterized by comprising a method and apparatus for forming ice sculptures, and especially ice sculptures of large size. One embodiment thereof utilizes a rubber-like resilient stretchable mold of the piece which is to be the object of the ice sculpture is formed by a spraying operation to produce a rubber-like mold made up of a plurality of the aforesaid layers formed over the object to be produced. Rigid metallic mold halves are formed preferably through a casting operation such as a sand casting operation to form two rigid metallic mold halves, each having depressions conforming to the front and back, for example, of the object. The top end of the rigid mold halves, when joined together, is open. The rubber-like mold is positioned between the two mold halves which are designed so that when they are joined together, the open end of the rubber-like mold is aligned with the open end of said joined mold halves. The lower end of the mold halves includes a base assembly having casters for rollingly supporting the assembly to facilitate movement thereof. The rigid mold halves are formed of a metallic material having good conductivity to provide more uniform cooling of the forming ice sculpture.

The rubber-like mold is filled with a freezable liquid and is thereafter chilled to freeze the freezable liquid A clear ice sculpture is obtained through the use of filtered water.

The ice sculpture is removed by turning the molding assembly upside down; disassembling the rigid mold halves and peeling the rubber-like mold away from the mold halves leaving the completed ice sculpture arranged in the proper, upright position.

The rubber-like mold is preferably formed of a very soft rubber material and the number of layers sprayed should be at least two and preferably five or six.

The metallic mold halves not only provide uniform cooling, but significantly reduce the time for cooling. The rubber-like mold has been found to be reusable to make one hundred to two hundred ice sculptures.

In still another and preferred embodiment of the present invention, the rubber-like mold may be totally eliminated and at least one of the rigid mold halves is provided with a resilient compressible gasket to establish a liquid-tight seal arranged about the rim of the mold cavity. In the production of decorative ice forms or ice sculptures of large size the water expands quite considerably as it freezes. This expansion is significantly greater as the size of the decorative form is increased. The weight of the large decorative forms of interest is typically greater than 100 pounds and preferably in the range of 150 to 350 pounds. A 40 inch high ice form, for example, can break any rigid mold regardless of the material used to form the mold and in addition, the weight of the water placed in the mold is also a factor.

A mold capable of producing such large, decorative ice forms comprises a split mold of two mold halves each preferably cast of tempered aluminum. The mold halves are swingably joined together along one side thereof by means of spring-loaded hinges capable of yielding to the expanding forces of the forming ice while at the same time being adjusted to apply sufficient pressure to keep the mold closed and sealed to prevent leakage of the large body of water placed in the mold preparatory to the freezing process.

The mold halves are further provided with spring-loaded locks incorporating a toggle action closing pull which works against an adjustable high pressure spring with a large spring constant enabling both sides of the mold to expand equally and in a controlled manner due to the forces of the freezing water as it expands.

Although it is not necessary to do so, the mold may be provided with a latex liner having a design which conforms with the design of the cavity. The liner may simply be a thin gauge plastic liner or a liner of the type described above.

The mold is preferably filled with fresh water through the top open end. The ice is preferably formed slowly, typically over a span of 20 to 40 hours while maintaining a freezer temperature in the range from 28° to 30° F. The mold assembly is then removed from the freezer and left to stand at room temperature for approximately 30 minutes whereupon it is unlocked and the ice casting is released. In the event that a light latex is used, it can be peeled up and off. An insulating bag may be used to cover the open end to cause the water to freeze more uniformly over the height of the mold assembly.

OBJECT OF THE INVENTION AND BRIEF DESCRIPTION OF THE FIGURES

It is, therefore, one object of the present invention to provide apparatus for producing high-quality, large size ice sculptures having extremely fine detail in a simple manner.

Still another object of the present invention is to provide apparatus for producing ice sculptures and the like comprising the use of a thin rubber-like mold positioned between rigid metallic mold halves releasably secured during the chilling operation.

Still another object of the present invention is to provide apparatus of the character described wherein both said rubber mold and said metallic mold halves are formed from the object which is the subject of the ice sculpture.

Another object of the present invention is to provide apparatus for producing large, heavy ice sculptures and the like through the use of mold halves hingedly connected along one side thereof by means of spring-loaded hinges and being closed along an opposite side thereof by means of spring-loaded locks incorporating a toggle action closing pull which operates against an adjustable high pressure spring to provide uniform controlled expansion of the mold halves as the water freezes.

Still another object of the present invention is to provide a split mold assembly for use in forming large ice sculptures and the like including a resilient compressible gasket arranged along one of the mold halves and surrounding the mold cavity to provide a water-tight seal to prevent leakage during the freezing process.

Still another object of the present invention is to provide a novel split mold assembly for use in forming large ice sculptures and the like and further incorporating an insulating bag which is placed over the top open end of the mold half preparatory to placement in a freezer to assure more uniform freezing of the water.

The above, as well as other objects of the present invention will become apparent when reading the accompanying description and drawing in which:

FIG. 3 is an exploded perspective view showing first and second substantially rigid wheelable mold halves utilized in the sculpture forming process.

FIG. 4 is a perspective view showing the manner in which the rubber-like mold of FIG. 2 is placed against one of the rigid mold halves of FIG. 3.

Figure 8:
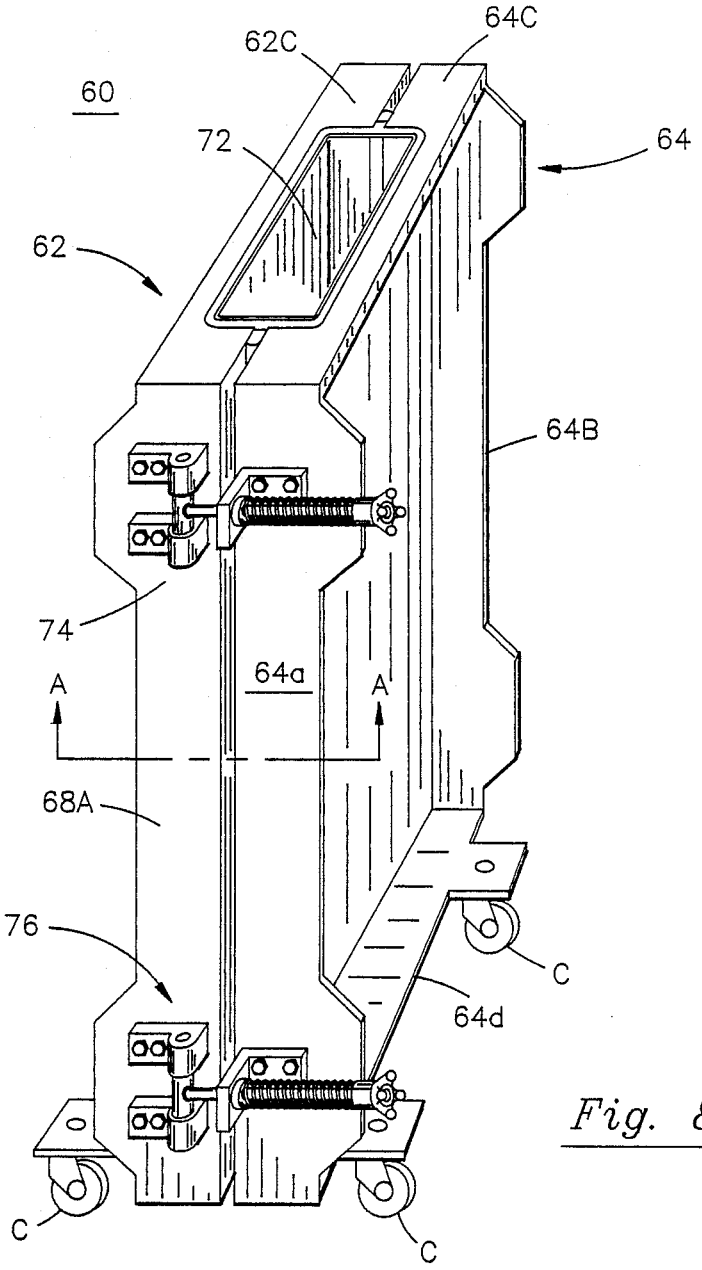
FIG. 8 shows a perspective view of still another preferred embodiment of the present invention.
Figure 8A:
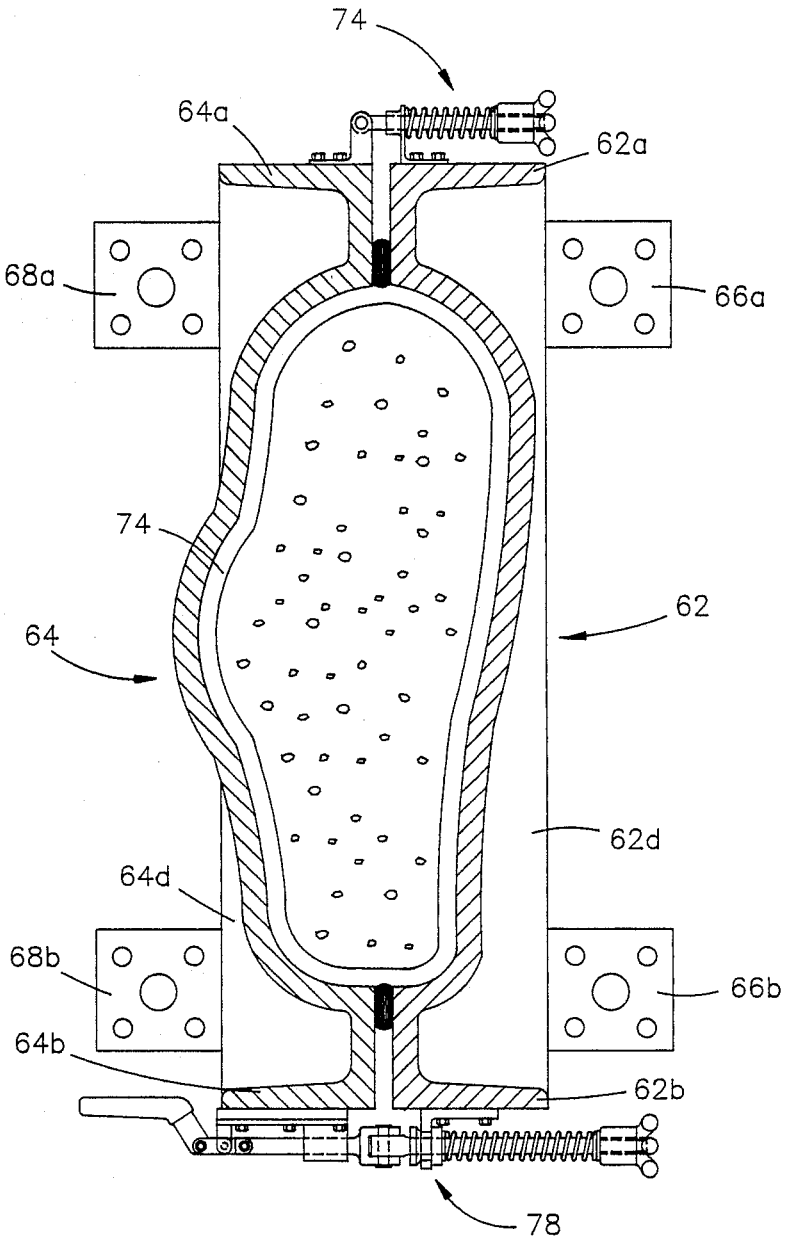

FIG. 8*a* shows a sectional view of the mold assembly of FIG. 8 looking in a direction of arrows 8*a*–8*a*.

Figure 8B:
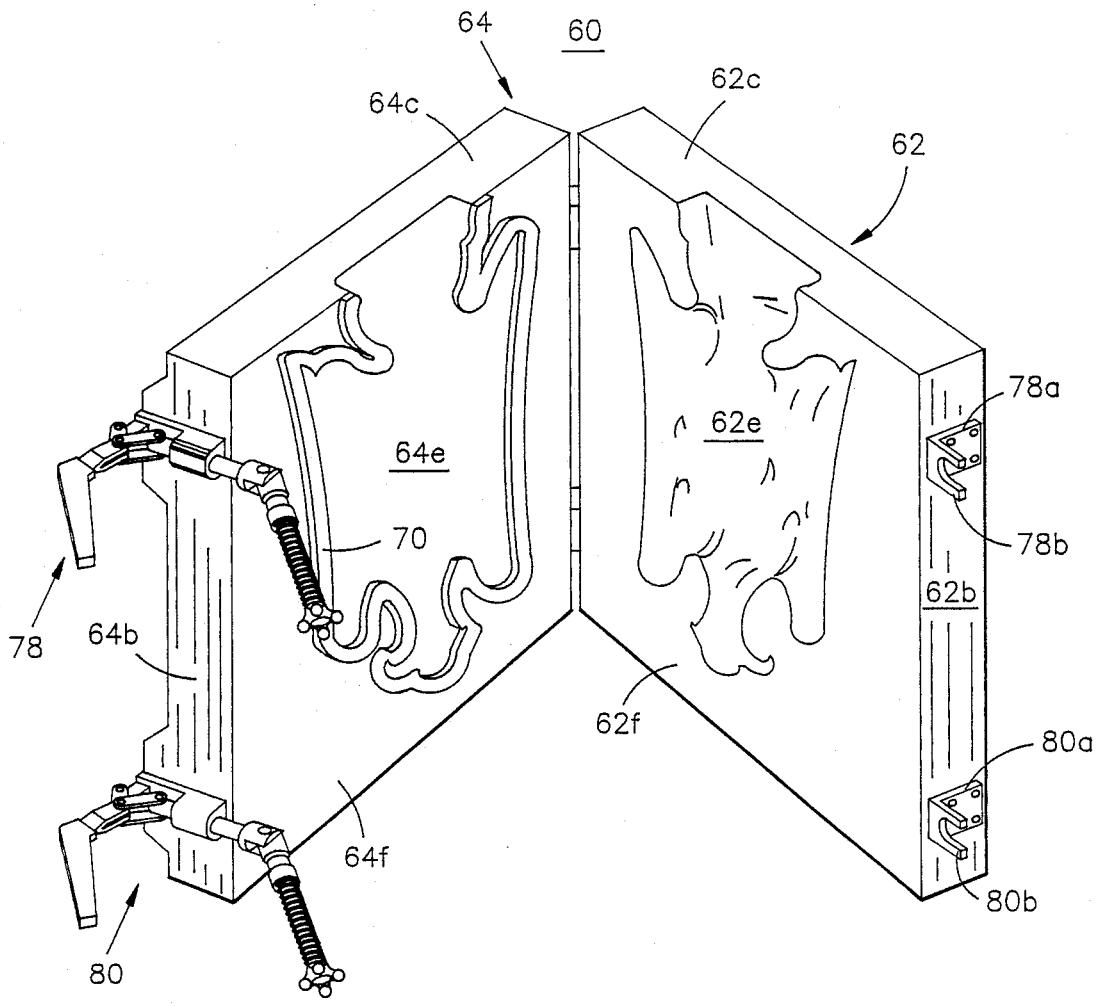

FIG. 8*b* is a perspective view of the mold assembly of FIG. 8 shown partially open.

Figure 9A:
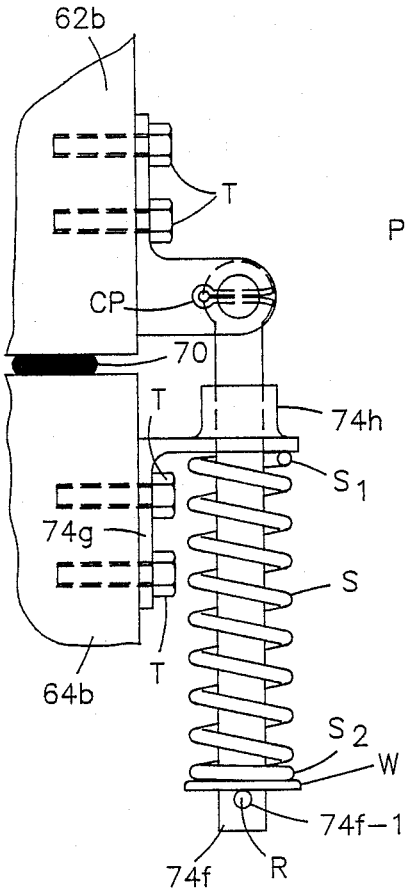
Figure 9B:
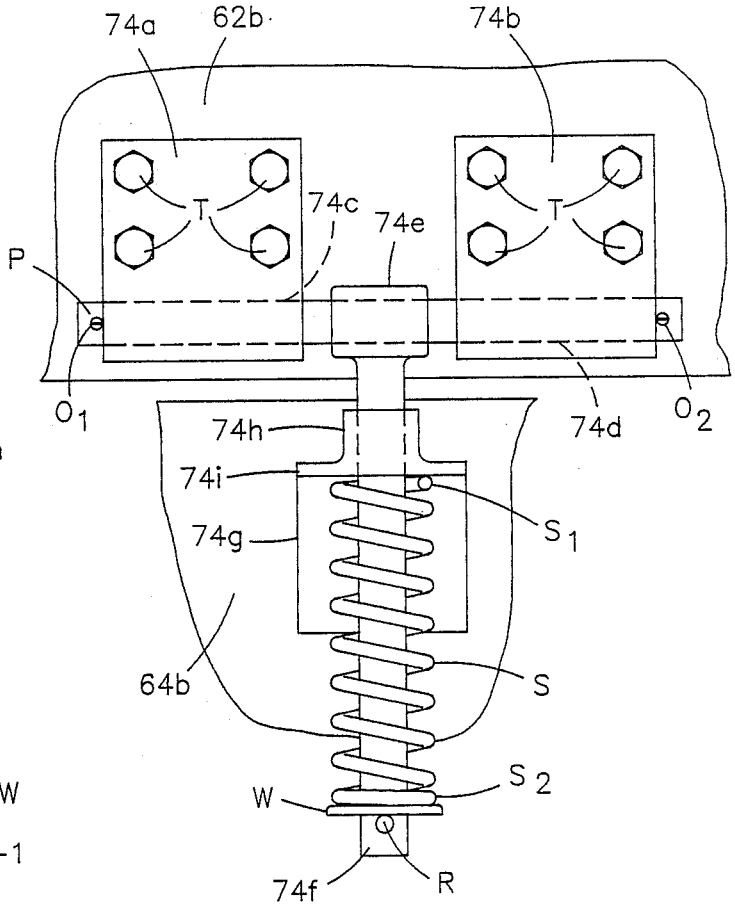

FIGS. 9*a* and 9*b* are plan and side views respectively of the high compression spring expansion hinges employed in the mold assembly of FIG. 8.

Figure 10A:
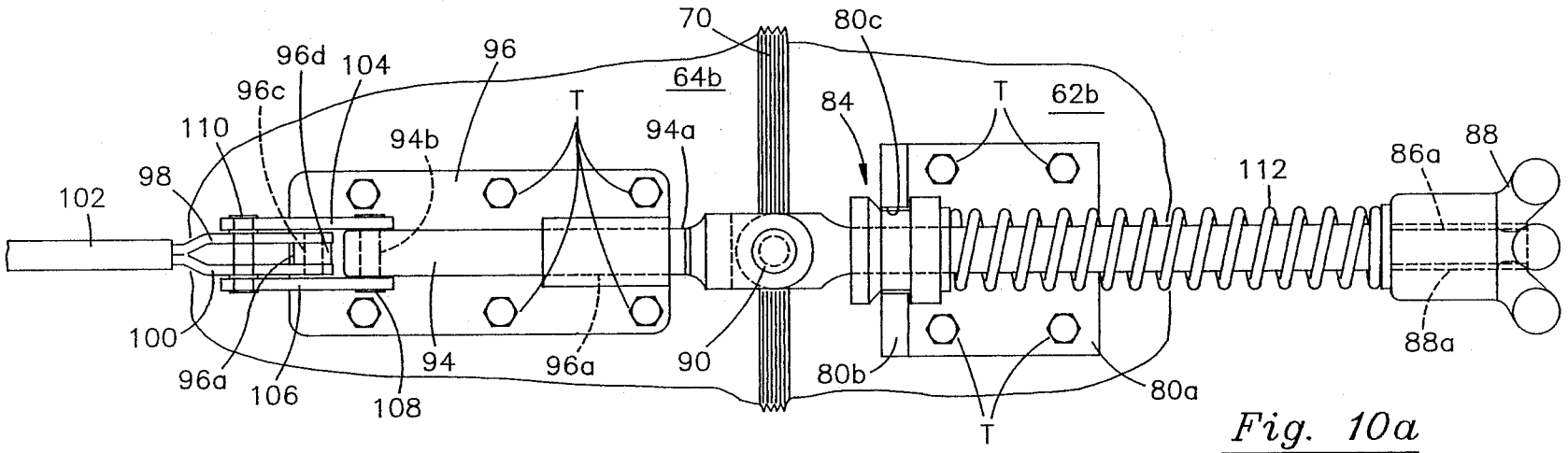
Figure 10B:
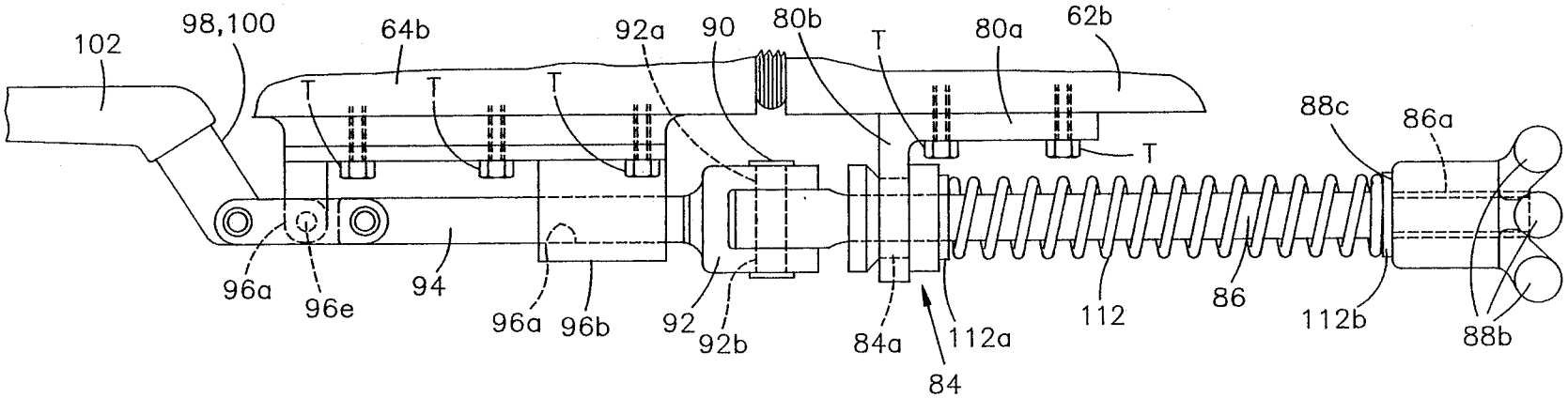

FIGS. 10 and 10*b* are plan and elevational views respectively of the high compression spring expansion lock assembly employed in the mold assembly of FIG. 8.

Figure 10C:
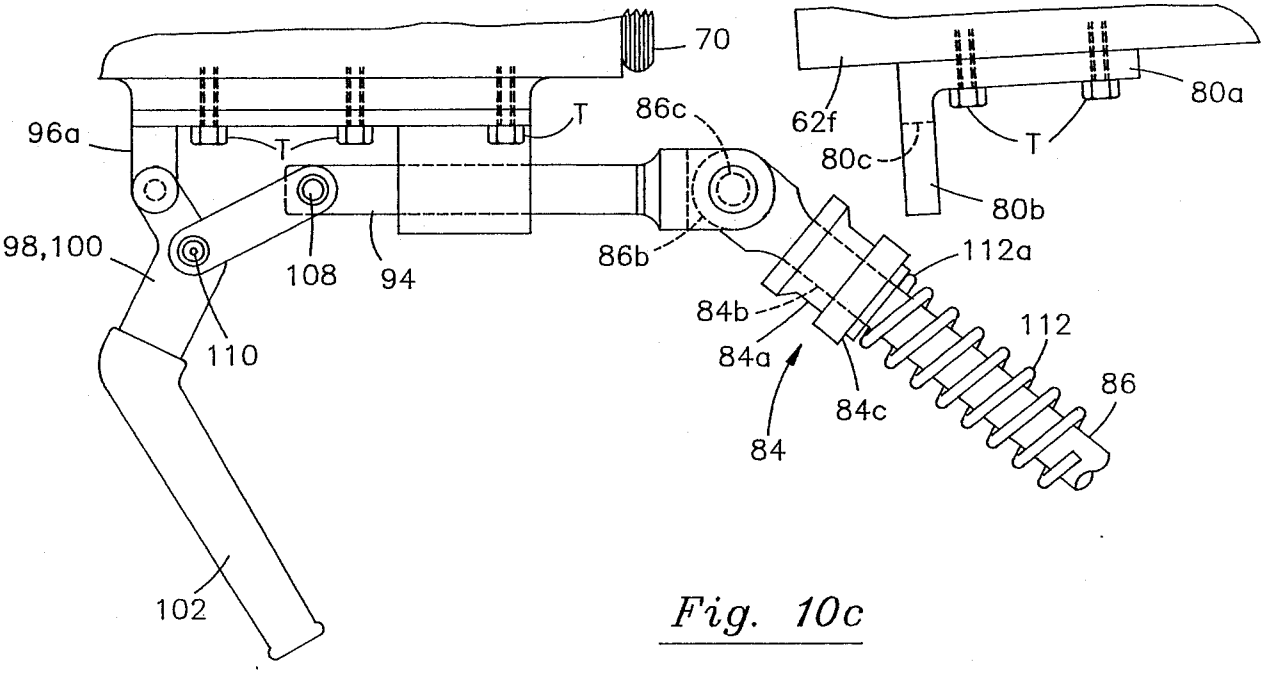

FIG. 10*c* shows the spring expansion lock assembly of FIGS. 10*a* and 10*b* in the open position.

Figure 11:
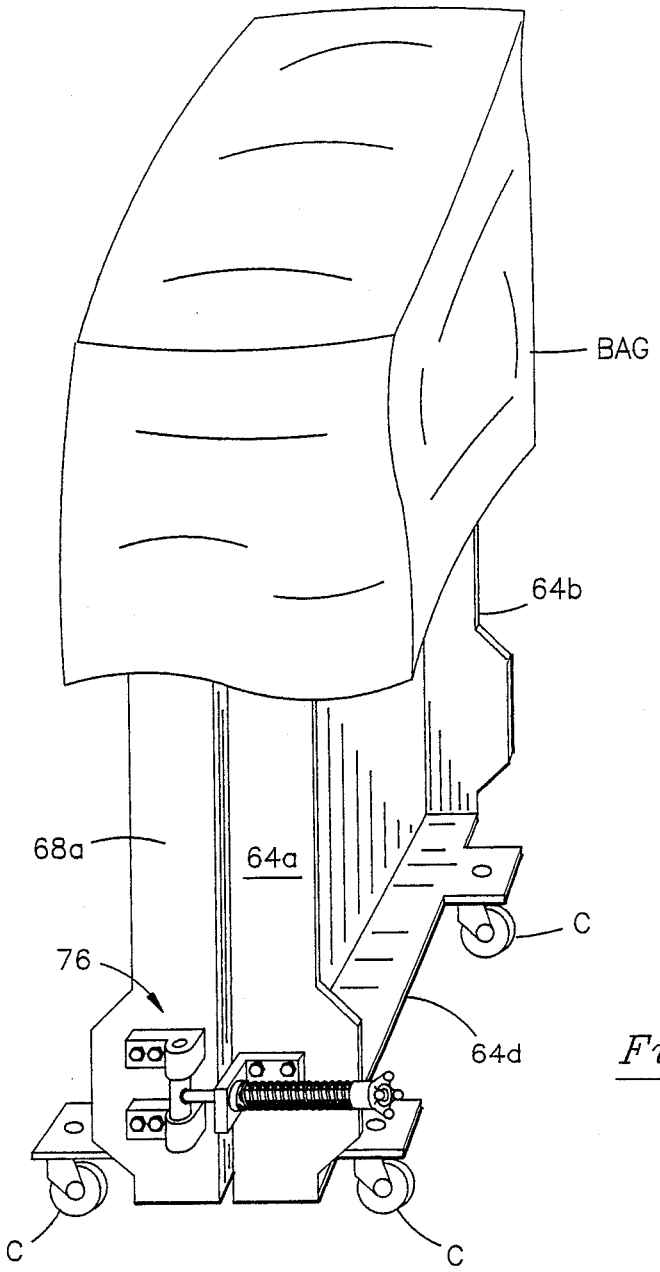

FIG. 11 shows a perspective view of the mold assembly of FIG. 8 preparatory to placement in a freezer.

DETAILED DESCRIPTION OF THE INVENTION

Figure 1:
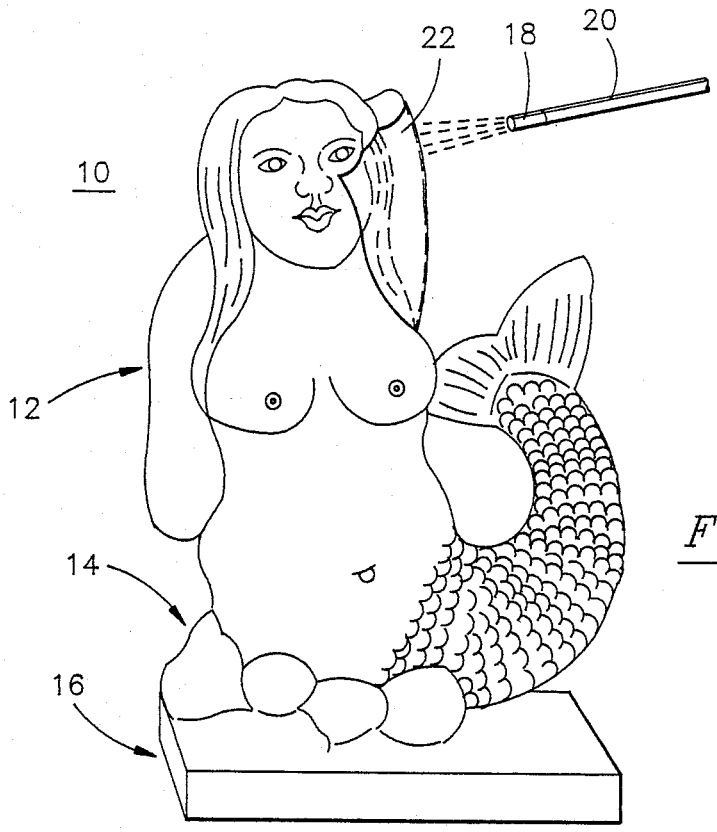
FIG. 1 is a perspective view showing a piece from which an ice sculpture may be formed and showing the manner in which the resilient rubber-like mold of the piece is formed.

The piece from which the sculptured ice piece is derived is initially prepared and may be any person or scene or object depending upon the particular objective or scene of the gathering in which the sculptured ice piece is to be used. For example, FIG. 1 shows a piece 10 which depicts a mermaid 12 resting upon some rocks 14, all of which are supported upon a substantially rectangular-shaped pedestal 16. The piece 10 may, for example, be formed of wood, plastic, plaster of paris, or any metal or any other suitable material. It is preferred that said material be a material other than ice, since the time and temperature conditions appropriate for forming the rubber-like mold are not conducive to retaining a sculptured ice piece in a frozen condition.

Figure 2:
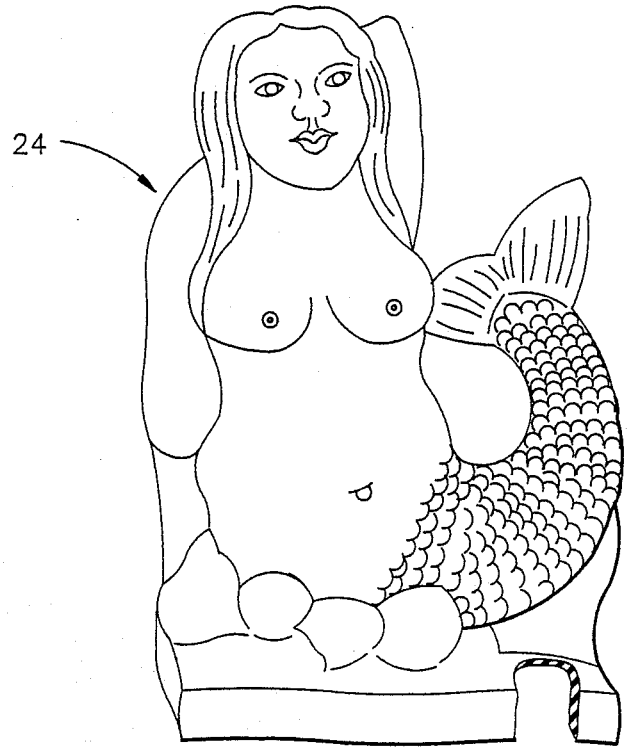
FIG. 2 is a perspective view showing the finished rubber mold with a portion of said mold removed to facilitate an explanation thereof.

A mixture of a soft rubber material, such as paratol latex adhesive in liquid form is sprayed from the nozzle 18 of a spraying device comprised of a conduit 20 coupled to a source of said liquid material and including a suitable pumping means (not shown) for pumping said liquid material from the source through said conduit 20 and out through the open end of nozzle 18 in order to be sprayed upon the piece 10. FIG. 1 shows object 10 with the rubber-like material 22 formed upon a portion of the piece 10 as the process is progressing. The liquid material is ultimately sprayed over the entire piece, including the mermaid 12, rocks 14, and the vertical sidewalls of pedestal 16. After the piece has been sprayed completely, the material is allowed to dry for a period of approximately 60 minute and is thereafter sprayed a second time. The second layer is also allowed to dry for a similar time period and, a third, forth and subsequent layers may be formed. Typically, five to six layers have been found sufficient to form a sturdy, serviceable mold which may be used to form a few hundred ice sculptures, so long as the rubber-like mold member is not abused in performing the method of the present invention. FIG. 2 shows a rubber-like mold 24 formed in accordance with the process described hereinabove in connection with FIG. 1. The thickness of a typical mold is of the order of ⅛ inches.

The piece 10 (which could be any large decorative form) is utilized to form a rigid mold assembly 30 comprised of the mold halves 32 and 34, shown in FIG. 3. Each of the mold halves 32 and 34 shown in FIG. 3 are preferably cast from aluminum, although any other type of metal having good conductivity may be employed. The mold halves are preferably formed using conventional sand molding techniques and are produced from the original piece 10 shown in FIG. 1. The resulting cast mold halves 32 and 34 are each comprised of a recess or depression 32*a*, 34*a*, representing the back and front respectively of the object 10, said depressions 32*a* and 34*a* being surrounded by substantially planar marginal portions 32*b* through 32*d* and 34*b* through 34*d* surrounding cavities 32*a*, 34*a* on three sides. The remaining sides are provided with elongated rectangular shaped recesses 32*e*, 34 which cooperatively define the pedestal portion 16 of object 10 as shown in FIG. 1.

The lower marginal portions 32*c*, 34*c* are bent to form base portions 32*f*, 34*f*, each of which is provided with a pair of caster assemblies 38 which rollingly support the rigid metallic mold halves 32 and 34.

Marginal portions 32*b* and 32*d* are provided with elongated projecting pins 36 which extend through cooperating openings 34*g* in marginal portion 34*b* and in 34*h* in marginal portion 34*d*. The metallic mold halves are joined together in a manner to be more fully described in connection with FIGS. 5 and 5*a*. Preparatory to the joining of the metallic mold halves 32 and 34, the resilient rubber-like mold 24 is placed within mold half 32, for example, shown best in FIG. 1, so that the back of the rubber-like mold rests within recess 32*a* of metallic mold half 32. Thereafter, metallic mold half 34 is aligned with mold half 32 and the mold halves are brought together. The preferred manner for securing the metallic mold halves 32 and 34 will be described hereinbelow.

With the metallic mold halves 32 and 34 securely fastened to one another, the open end of rubber-like mold 24 is filled with water, preferably filtered, and is placed in a suitable freezer. Base portions 32*f*, 34*f* of metallic mold halves 32, 34 are each provided with a pair of elongated threaded fasteners 42 which threadedly engage tapped openings 32*j* and 32*k* in base portion 32*f*. The threaded members 42 are selectively rotated to extend further downwardly in the direction shown by arrows 44 so that their lower ends extend below the casters 38 to prevent the mold assembly 30 from rolling upon the supporting surface.

The assembly 30 is kept in the freezer until the water in rubber-like mold 24 freezes, at which time the assembly 34 may be removed from the freezer. The time required for freezing the ice sculpture is reduced due to the employment of a relatively thin rubber-like mold 24 and the employment of the first and second metallic mold halves 32 and 34 which uniformly cool the water in mold 24 due to the conductivity of the mold halves 32 and 34.

The rigid mold halves 32 and 34 serve to cause the rubber-like mold 24 to retain its integrity and the rubber-like mold experiencing no noticeable distortion in spite of the weight of the water, to assure formation of an ice sculpture which is identical in every feature to the original object 10. The use of a continuous seamless rubber-like mold 24 prevents the formations of any seams on the finished ice sculpture. The use of filtered water assures the formation of an ice sculpture with good, uniform clarity.

Figure 6:
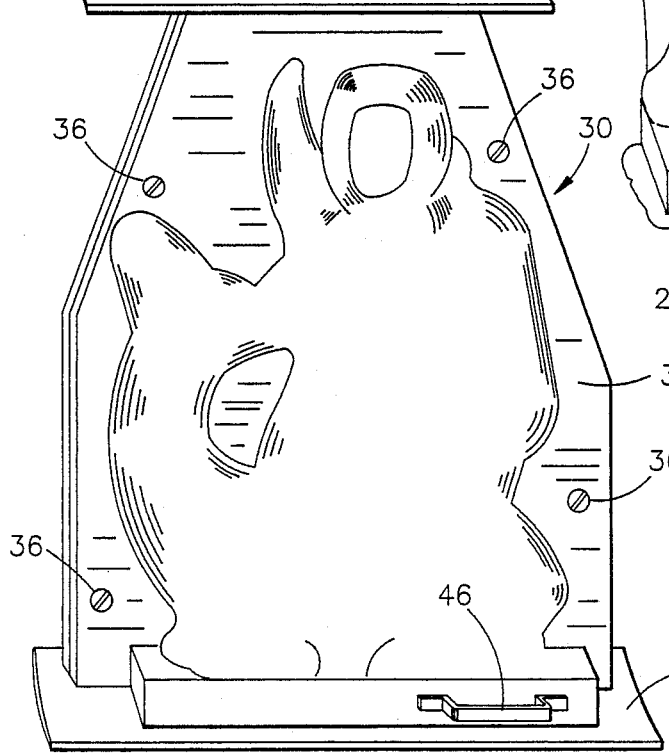
FIG. 6 is a perspective view showing the portion of the assembly shown in FIG. 5 in readiness for removal of the sculptured ice piece.
Figure 7:
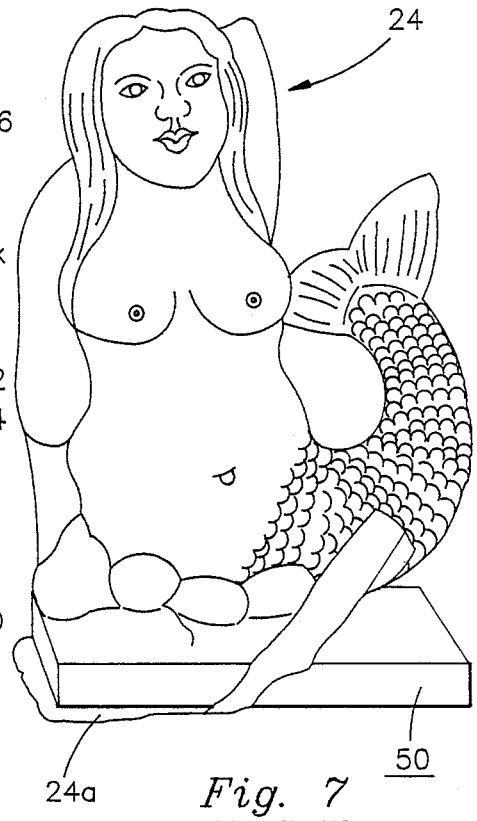
FIG. 7 shows the completed sculptured ice piece arranged within the rubber-like mold and the manner in which the rubber-like mold is removed.

When the water is frozen throughout, the assembly 30 is removed from the freezer and turned upside-down in the manner shown in FIG. 6. The assembly 30 is preferably placed upon a table or board upon which the finished ice sculpture is to be displayed, such as, for example, the support surface 48. Each of the rigid mold halves 32, 34 is provided with a handle, such as, for example, a handle 46 provided on mold half 32, to facilitate handling and transportation of the assembly 30. The mold halves 32 and 34 are separated from one another, leaving the sculptured ice piece 40 within the rubber-like mold 24. The lower marginal portion 24*a* of rubber-like mold 24 is peeled away from the ice sculpture simply by lifting the rubber-like mold lightly away from the ice sculpture and pulling the rubber-like mold upwardly. The nature of the rubber material is such as to be easily peeled away from the ice sculpture. The rubber material is sufficiently resilient and stretchable to withstand being pulled away from ice sculpture 50 without undergoing any permanent distortion, tearing, or other damage. The details of the finished ice sculpture are identical in every respect to the original piece, the finished ice sculpture 50 is perfectly clear, contains no bubbles and no noticeable seams or other imperfections.

The metallic mold halves 32 and 34 may be used indefinitely to produce an extremely large number of ice sculptures. The rubber-like mold 24 has been found to be capable of producing at least a few hundred ice sculptures before suffering any noticeable deterioration. The rigid mold halves 32, 34 support the rubber-like mold over its entire surface area to assure that the finished product will contain no noticeable distorted features or characteristics.

The mold halves may be held together by using toggle clamps. The toggle clamps may be placed in any advantageous position around the periphery of the mold halves, and may be varied in placement and number to suit the particular mold. Furthermore, the toggle clamps may be provided with spring reliefs, allowing expansion of the mold halves caused by freezing of the ice in the mold without placing undue stress upon the mold halves or causing the mold halves to break apart entirely.

Figure 5:
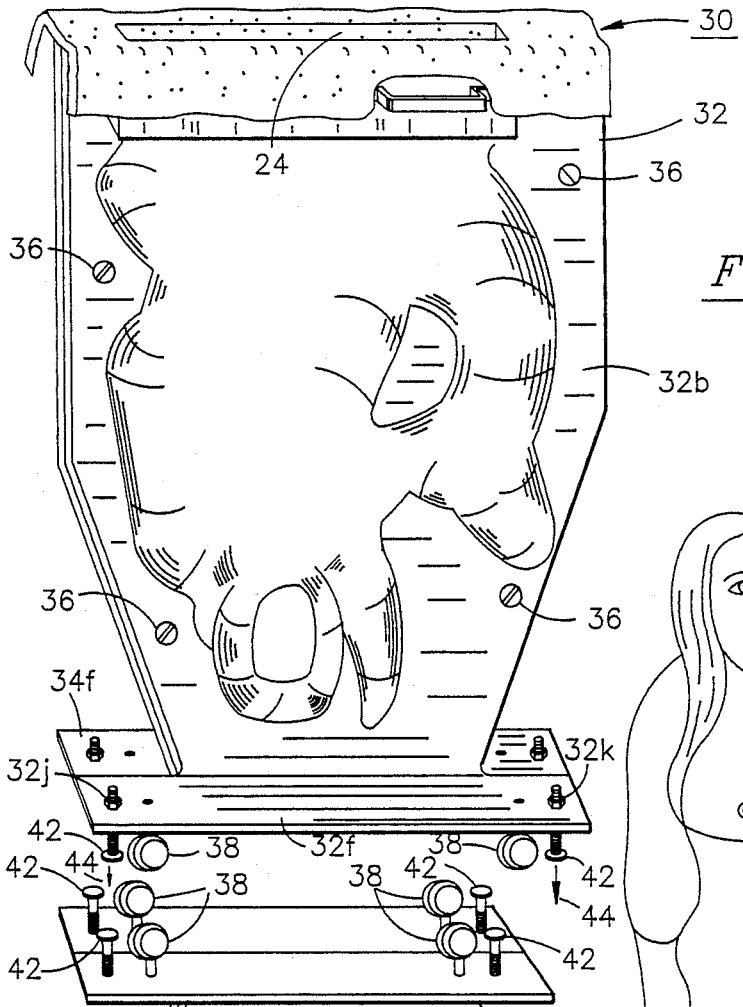
FIG. 5 is a perspective view showing the two rigid mold halves of FIG. 3 and the rubber-like mold of FIG. 2 fully assembled in readiness form forming an ice sculpture.

In still another preferred embodiment of the present invention which fully takes into account the significant expansion of the water during the freezing process of large decorative ice forms, is provided a mold assembly 60 comprised of mold halves 62, 64 which are preferably formed of a metallic material such as aluminum and in which the decorative ice form is produced, for example, by a stamping or by a sand casting operation. The mold assembly of FIG. 5 is not capable of molding large ice forms without breaking due to the significant expansion experienced by the water when making molds of a height of several feet and weighing from 100 to 300 pounds when frozen.

Each of the mold halves is preferably provided with four sides arranged at right angles to the land portions of each mold half to greatly enhance the structural strength of each mold half. Note, for example, mold half 64 having vertical sides 64*a* and 64*b* and top and bottom sides 64*c*, 64*d*. Mold half 62 has a similar arrangement, top side 62*c* and vertical side 62*a* being shown in FIG. 8 and vertical sides 62*b* and 62*a* and bottom side 62*d* being shown and the bottom sides 62*d* and 64*d*, as shown best in FIG. 8*a* are provided with plates 66*a* through 66*b* and 68*a* and 68*b*, respectively for mounting swingable, rollable casters C to facilitate rolling movement of the mold assembly.

FIG. 8*b* shows the mold assembly 60 in the partially open position with the cavity portions 64*e*, 62*e* exposed to view. The land portion 64*f* surrounding cavity 64*e* is provided with a resilient compressible seal or gasket 70 which is arranged on the land portion 64*f* immediately surrounding cavity 64*e* and substantially conforming to the shape of the cavity perimeter. The resilient compressible gasket 70 engages the land portion 62*f* of mold half 62 in the region surrounding the-perimeter of cavity 62*e*. The land portion of either mold half may receive gasket 70.

As can clearly be seen from FIGS. 8 through 8*b*, with the mold in the closed position, cavities 62*e*, 64*e* collectively form the mold cavity having an open top end 72.

Mold halves 62 and 64 are hingedly joined by means of compression/expansion spring hinge assemblies 74, 76. Since these hinge assemblies are substantially identical to one another in both design and function, only one such hinge assembly will be described herein for purposes of brevity.

FIGS. 8 through 8*b* and 9*a* and 9*b* show an expansion hinge assembly 74 secured to sides 62*b* and 65*b* of the mold halves 62 and 64. The hinge assembly is comprised of first and second hinge pin brackets 74*a*, 74*b* receiving a plurality of threaded fasteners T for securing the hinge pin brackets to side 62*b*. A hinge pin P extends through the coaligned bores 74*c*, 74*d* provided in the brackets 74*a* and 74*b* as shown. The hinge pin P is provided with openings $O_1$ and $O_2$ for receiving cotter pins such as the cotter pin CP shown in FIG. 9*a*, to retain the hinge pin P in the proper position and to prevent accidental removal of the hinge pin from the hinge pin brackets.

A swing bolt 74*e* is provided with an opening for receiving hinge pin P and has an elongated cylindrical rod portion 74 integral therewith and extending away from the hinge pin in the manner shown in FIGS. 9*a* and 9*b*.

An L-shaped expansion spring load bracket consists of a mounting portion 74*g* receiving threaded fasteners T for securing the bracket to portion 64*b* of mold half 64. The remaining portion thereof is provided with a collar 74*h* having an opening through which cylindrical rod 74*f* extends. A flat wire compression spring S has one end thereof S1 bearing against the surface 74*i* and has the other end S2 thereof bearing against a washer W which is maintained in position by a retainer pin R extending through an opening 74*f*1 provided in cylindrical rod 74*f*. Spring S is maintained under a predetermined amount of compression to urge the expansion spring load bracket toward the hinge pin brackets and hence urging the mold halves 62 and 64 toward one another thereby placing rubber seal 70 under compression. Although the high compression spring expansion hinge 74 provides an excellent high compressive force to place rubber seal 70 under compression and thereby provides an excellent watertight seal, the mold is nevertheless easily opened (or closed) by swinging mold halves apart (or together) about the axis of hinge pin P.

In addition thereto, the high compression spring expansion hinge allows the mold halves to be displaced from the one another as shown by the arrow A representing the direction of expansion of the water as it freezes thus enabling the mold to become displaced to fully accommodate the expansion of the freezing water.

As shown best in FIGS. 8*a*, 8*b* and 10*a* through 10*c*, the mold assembly 60 is provided with a pair of high compression spring expansion locks 78 and 80. Since these expansion locks are substantially identical in both design and function, only one of said lock assemblies will be described herein for purposes of simplicity. As shown in FIGS. 8*a*, 8*b* and 10*a* through 10*c*, expansion lock assembly 80 is comprised of an L-shaped mounting bracket having a mounting portion 80*a* secured at 62*b* to mold half 62. The remaining portion 80*b* is provided with a U-shaped slot 80*c* for receiving the reduced diameter portion 84*a* of a hollow cylindrical shaped member 84 having a hollow center defining an opening 84*b* for slidably receiving elongated cylindrical rod 86 having a threaded end portion 86*a* for threadedly coupling the pressure adjusting knob 88 having a tapped opening 88*a*. Rounded projections 88*b* are provided to facilitate gripping and rotation of adjusting knob 88.

The left-hand end of rod 86 is provided with an enlarged head portion 86*b* provided with an opening 86*c* for receiving pin 90 which extends through opening 86*c* and openings 92*a*, 92*b* in the bifurcated arms of a substantially Y-shaped member 92 to form a safety clevis joint with the end 86*b* of rod 86. Member 92 is rotatably joined to one end 94*a* of an elongated rod 94 of substantially square shaped cross-section. Member 94 extends through a square-shaped opening 96*a* provided within an integral projection 96*b* of a second mounting bracket 96 secured at 64*b* of mold half 64 by threaded fasteners T.

The mounting bracket 96 is provided with a further projection 96*c* which has an opening 96*d* for receiving a pin 96*e* for joining the right-hand ends of elongated plates 98, 100 whose left-hand ends are secured to an operating handle 102.

A second pair of plates 104, 106 have their right-hand ends pivotally joined to the left-hand end of square-shaped rod 94 by means of a pin 108 extending through an opening 94*b* in the left-hand end of rod 94. The left-hand ends of plates 104, 106 are pivotally joined to plates 98, 100 at a point substantially intermediate their left-and right-hand ends by means of a pin 110.

The hinge and clamping assemblies of FIGS. 8 through 11 may also be employed in the mold assembly of FIGS. 3 through 6.

The manner in which the toggle action high compression spring expansion lock assembly operates as follows:

Assuming that the mold halves are open, for example, as shown in FIG. 10*c*, the mold halves are moved toward one another so as to bring the surface of land 62*f* (see FIG. 8*b*) into engagement with gasket 70. If necessary, gasket 70 is placed under at least slight compression by an amount sufficient to enable rod 86 to be rotated from the position shown in FIG. 10*c* toward the position shown in FIG. 10*b* to enable the reduced diameter portion 84*a* to be moved into the U-shaped slot 80*c* in bracket portion 80*b*.

With rod 86 and member 84 in the position shown in FIG. 10*b* and with the toggle assembly in the unlocked position as shown in FIG. 10*c*, the operating handle is moved from the position shown in FIG. 10*c* to the position shown in FIG. 10*b* causing the square-shaped rod 94 to be drawn toward the left thereby pulling bifurcated member 92 and rod 84 toward the left to place helical spring 112, which surrounds elongated rod 86, under compression. The left-hand end at 112*a* of spring 112 bears against surface 84*c* of member 84 while the right-hand end 112*b* of spring 112 bears against the surface 88*c* of pressure adjusting knob 88. The toggle action is an over-center toggle action causing the locking assembly to be maintained in the locked position under the force of spring 112. The spring force of the compression spring 112, together with adjustment of pressure adjusting knob 88 serves to maintain adequate pressure upon seal 70 to maintain seal 70 under compression to assure a good watertight seal when the mold halves are so joined and locked.

As the water freezes, it expands causing the mold halves to be moved apart whereupon the high compression spring 112 undergoes still further compression in a substantially controlled manner to normally initially maintain the seal 70 under compression to provide an excellent watertight seal during the initial freezing of the water while providing controlled expansion as the water freezes, the compressible seal being of a size so as to be initially compressed sufficient to seal the space between lands 62*f* and 64*f* and to maintain the seal for a period of time sufficient to assure that the water will freeze before the displacement distance between lands 62*f* and 64*f* becomes greater than the expanded thickness of seal 70.

The toggle assembly may be unlocked by moving the handle past the locked over-center position to the position shown in FIG. 10*c* which is typically performed when it is desired to open the mold assembly.

It should further be noted from a consideration of FIG. 8*a*, for example, that the high compression expansion hinges may also be made adjustable by providing pressure adjusting knobs in place of the hinge pin utilized in the embodiment shown in FIGS. 9*a* and 9*b*. This is easily accomplished by providing a threaded portion at the free end of elongated rod 74*f* and mounting a pressure adjusting knob 116 having a tapped opening upon the threaded right hand end of rod 74*f*. The left-hand end of the knob bears against the compression spring and is adjusted to apply the desired amount of closing force.

The decorative ice form is produced in the following manner.

The mold assembly is closed by placing toggle locks 78 and 80 in the locked position in the manner described and the mold assembly is placed with the casters C resting upon the ground or other suitable supporting surface.

Water is poured into the mold cavities substantially to a level close to the top of the mold typically 3 to 4 inches from the top. Alternatively, the mold may be provided with a latex liner which would be filled with water in the same manner, although this arrangement is not necessary due to the effectiveness of the seal 70.

The mold assembly, which is rather heavy now since it contains anywhere from at least 100 to 200 to 300 pounds of water as well as the weight of the mold assembly itself (typically several hundred pounds), is rolled into a freezer compartment such as walk-in freezer (not shown for purposes of simplicity). The mold assembly which is now filled with water is maintained in the freezer for a period of the order of 20 hours or so while maintaining a temperature of the order of 28° to 32° F.

The mold is then removed from the freezer and left to stand at room temperature for at least 30 minutes. After this standing time the mold assembly is turned upside down in order to place the ice sculpture right side up whereupon the toggle locks are opened and the ice sculpture is removed and then returned to the freezer until it is ready for use.

The mold should preferably be filled with water to within three inches from the top open end. In the event that local water contains impurities that may cloud the center of the ice, food coloring may be used to color the water. The clarity of the ice may also be improved by using either distilled or boiled water. Air should be removed from the water in order to provide a crystalline appearance to the ice sculpture.

Colors may be layered in the ice mold by freezing one color layer at a time than adding another color layer.

Freezing of the water may take place more evenly by placing an insulating bag over the open top end of the filled mold assembly in the manner shown in FIG. 11. The insulated bag prevents the uppermost portion of the water within the mold cavity from freezing first.

The molded members formed weigh at least 100 pounds and typically anywhere from 160 to 300 pounds frozen. The ice mold is an aluminum casting weighing between 200 to 250 pounds depending upon the ice creation being molded. The mold is preferably formed of a tempered aluminum and has a baked white enamel finish which is preferably baked on at a temperature in excess of 350° F. to facilitate the ease of removal of the ice mold. If desired any other finish may be employed for the purpose of facilitating removal of the finished ice form.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein described.

What is claimed is:

1. A mold assembly for producing ice sculptures comprising first and second mold halves each having a planar surface;

each of said mold halves having a cavity recessed in said planar surface;

said cavities cooperating to define a hollow mold having a surface shape for producing the desired ice sculpture when said mold halves are joined together with their respective planar surfaces facing one another;

said cavities cooperatively forming an opening along one side of the joined mold halves for receiving water;

means arranged between the planar surfaces of said mold halves for providing a water-tight seal around said hollow mold to prevent leakage of water from the hollow mold when the mold halves are joined;

joining assemblies arranged along opposite sides of the mold assembly for normally urging the mold halves together to initially maintain said water-tight seal and being resiliently yieldable to enable the mold halves to move apart in a controlled manner due to expansion of the freezing water in the mold.

2. The mold assembly of claim 1 wherein said joining assemblies include a plurality of hinge assemblies for hingedly joining said mold halves along one side of the mold assembly to enable said mold halves to be swingable about a predetermined axis between an open and closed position.

3. The mold assembly of claim 2 wherein said hinge assemblies each include a resiliently yieldable means for normally urging said mold halves toward one another and being resiliently yieldable to permit the mold halves to be moved apart due to expansion of the water in the hollow mold as the water freezes.

4. The mold assembly of claim 3 wherein said yieldable means comprises a spring.

5. The mold assembly of claim 3 wherein said yieldable means comprises a helical spring.

6. The mold assembly of claim 2 wherein said hinge assemblies are each comprised of;

a first hinge bracket secured to one of said mold halves;

an elongated rod having one end pivotally joined to said first hinge bracket;

a second hinge bracket having a first arm secured to the remaining one of said mold halves and having a second arm extending from said first arm and being provided with an opening;

said rod extending through said opening and having a stop arranged a predetermined distance from a first end of said rod;

spring means arranged along said rod and being compressed between said stop and said second arm for normally urging said mold halves together.

7. The mold assembly of claim 1 wherein said seal means is comprised of a resilient compressible gasket, said yieldable joining assemblies compressing said gasket by an amount sufficient to provide a good watertight seal between said mold halves.

8. The mold assembly of claim 6 wherein said stop further comprises an adjustable handle movable along said rod for adjusting the compression force exerted upon the spring by movement of said stop.

9. The mold assembly of claim 1 wherein said joining assemblies comprises a plurality of releasable joining means arranged along one side of the mold assembly for releasably joining the mold halves to enable the mold halves to be moved between an open position for removing a completed ice sculpture and a closed position for receiving water.

10. The mold assembly of claim 9 wherein said releasable joining means includes spring means for urging the mold halves together and being sufficiently yieldable to permit the mold halves to move apart in a controlled manner as the water expands due to freezing.

11. The mold assembly of claim 9 wherein said releasable joining means comprises a first mounting bracket secured to one of said mold halves and having a holding slot;

an elongated rod slidably extending through said slot;

a second mounting bracket secured to the remaining one of said mold halves;

a slide arm slidably within a slide arm guide provided in said bracket;

swingable joint means for swingably coupling one end of said slide arm end of said elongated rod;

said rod having a stop arranged a predetermined distance from said one end of said rod;

a spring arranged along said rod and being compressed between said stop and said first bracket for urging said slide arm toward said first bracket;

a toggle operating assembly pivotally coupled between said second bracket and said slide arm for moving said slide arm away from said first bracket when in a first position and for moving said slide arm toward said first bracket when in a second position;

said joint means enabling said rod to be swingable from a first position extending through said slot and a second position displaced from said slot to facilitate opening of said mold assembly by separation of said mold halves.

12. The mold assembly of claim 11 wherein said pivotal coupling assembly comprises a universal joint assembly.

13. The mold assembly of claim 11 wherein said pivotal coupling assembly comprises a clevis joint assembly.

14. The mold assembly of claim 11 wherein the toggle assembly comprises an over-center toggle assembly.

15. The mold assembly of claim 11 wherein said toggle assembly comprises an operating arm having a handle arranged near a first end thereof, the second end being pivotally coupled to said second bracket;

at least one toggle link being pivotally joined at one of the ends to said slide arm and being joined at its opposite end to said operating arm, the last-mentioned pivotal coupling being a predetermined distance inward along said operating arm from the pivotal coupling between said operating arm and said second bracket.

16. The mold assembly of claim 3 wherein said joining assemblies further include a plurality of releasable joining means arranged along one side of the mold assembly opposite the side of the mold assembly provided with said hinge assemblies for releasably joining the mold halves to enable the mold halves to be moved between an open position for removing a completed ice sculpture and a closed position for receiving water.

17. The mold assembly of claim 9 wherein said joining assemblies further include a plurality of hinge assemblies to hingedly join said mold halves along a side of the mold assembly opposite the side of the mold assembly having the releasable joining means to enable said mold halves to be swingable about a predetermined axis between an open and closed position.

18. The mold assembly of claim 1 further comprising hollow bag-shaped insulating means having an open end being positioned over the opening of said assembly to reduce the tendency of water in the hollow mold to freeze before the water near the end of the mold assembly opposite said opening.

19. The mold assembly of claim 1 further comprising a plurality of casters arranged along the portion of the mold assembly opposite said open end.

20. The mold assembly of claim 1 wherein the size of said hollow mold is sufficient to contain at least 100 pounds of water in the liquid state.

21. The mold apparatus of claim 1 wherein said hollow mold has a volume of at least 1.5 cubic feet.

22. The mold assembly of claim 1 wherein said yieldable means is sufficiently yieldable to enable the mold halves to move apart a distance sufficient to allow the mold halves to separate without breaking caused by expansion of the water in the hollow mold due to freezing.

23. The mold assembly of claim 1 wherein said mold halves are formed of a conductive metal.

24. The mold assembly of claim 23 wherein said metal is aluminum.

25. The mold assembly of claim 24 wherein a protective surface coating is provided covering at least said mold cavities.

26. The mold assembly of claim 25 wherein said protective coating is baked enamel.

27. The mold assembly of claim 26 wherein said protective coating is baked onto said mold halves at a temperature of the order of 350° F.

* * * * *

UNITED STATES PATENT AND TRADEMARK OFFICE

CERTIFICATE OF CORRECTION

PATENT NO. : 4,817,911

DATED : April 4, 1989

INVENTOR(S) : Vittorio Infanti

It is certified that error appears in the above-identified patent and that said Letters Patent is hereby corrected as shown below:

At Column 11, line 32, after "slidably" insert --mounted--

At Column 12, line 29, after "said" insert --mold--

Signed and Sealed this

Twelfth Day of March, 1991

*Attest:*

HARRY F. MANBECK, JR.

*Attesting Officer*

*Commissioner of Patents and Trademarks*